US010259672B2

(12) United States Patent
Akatsuka et al.

(10) Patent No.: US 10,259,672 B2
(45) Date of Patent: Apr. 16, 2019

(54) IMAGE FORMING APPARATUS AND SHEET CONVEYING UNIT

(71) Applicant: CANON KABUSHIKI KAISHA, Tokyo (JP)

(72) Inventors: Junya Akatsuka, Kawasaki (JP); Masaki Tanaka, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 142 days.

(21) Appl. No.: 15/154,775

(22) Filed: May 13, 2016

(65) Prior Publication Data

US 2016/0342126 A1 Nov. 24, 2016

(30) Foreign Application Priority Data

May 21, 2015 (JP) ..... 2015-103961

(51) Int. Cl.
*B65H 29/58* (2006.01)
*B65H 85/00* (2006.01)
(Continued)

(52) U.S. Cl.
CPC ..... *B65H 29/58* (2013.01); *B65H 29/14* (2013.01); *B65H 85/00* (2013.01); *G03G 15/23* (2013.01); *B65H 2301/33312* (2013.01); *B65H 2404/143* (2013.01); *B65H 2404/6111* (2013.01); *B65H 2404/632* (2013.01)

(58) Field of Classification Search
CPC .... G03G 15/23; G03G 15/231; G03G 15/232; G03G 15/234; G03G 15/6579; G03G 2215/00586; G03G 2215/0043; G03G 2215/00438; B65H 29/125; B65H 29/14; B65H 29/58; B65H 29/60; B65H 85/00; B65H 2301/132; B65H 2301/1321; B65H 2301/333; B65H 2301/33312; B65H 2301/3331; B65H 2404/63;
(Continued)

(56) References Cited

U.S. PATENT DOCUMENTS 3,942,785 A * 3/1976 Stange ..... B65H 29/12 271/184
8,862,045 B2 * 10/2014 Miyake ..... B65H 5/062 399/395
(Continued)

FOREIGN PATENT DOCUMENTS

JP 2004-352434 A 12/2004
JP 2006-062862 A 3/2006
JP 2008162744 A 7/2008

*Primary Examiner* — Ernesto A Suarez
(74) *Attorney, Agent, or Firm* — Canon U.S.A., Inc. IP Division

(57) ABSTRACT

An image forming apparatus for forming an image on a sheet includes an image forming unit, a first pair of rollers, a second pair of rollers, and a holder. The image forming unit is configured to form an image on a sheet. The first pair of rollers is configured to discharge the sheet out of the apparatus, the image having been formed on a first surface of the sheet by the image forming unit. The second pair of rollers is configured to convey the sheet again to the image forming unit to form an image on a second surface of the sheet opposite to the first surface. The holder is configured to hold one of the first pair of rollers and one of the second pair of rollers.

6 Claims, 7 Drawing Sheets

(51) Int. Cl.
*B65H 29/14* (2006.01)
*G03G 15/23* (2006.01)

(58) Field of Classification Search
CPC ..... B65H 2404/632; B65H 2404/633; B65H 2404/143
See application file for complete search history.

(56) References Cited

U.S. PATENT DOCUMENTS

| | | | | |
|---|---|---|---|---|
| 8,909,124 | B2 * | 12/2014 | Kuwata | G03G 15/234 399/388 |
| 8,991,824 | B2 * | 3/2015 | Suzuki | G03G 15/234 271/265.01 |
| 2016/0209797 | A1 * | 7/2016 | Torii | B65H 5/36 |
| 2016/0349678 | A1 * | 12/2016 | Maeda | G03G 15/234 |
| 2016/0368726 | A1 * | 12/2016 | Hayakawa | B65H 29/60 |

* cited by examiner

IMAGE FORMING APPARATUS AND SHEET CONVEYING UNIT

BACKGROUND OF THE INVENTION

Field of the Invention

The present invention relates to an image forming apparatus and a sheet conveying unit.

Description of the Related Art

Image forming apparatuses are configured to supply sheets one by one from a sheet feed tray, in which sheets are stacked, to an image forming unit, and after forming images on the sheets on the basis of an input image signal at the image forming unit, to discharge the sheets out of the apparatus. One example of such image forming apparatuses has a configuration having the function of reversing a sheet in which an image is formed on one surface (a first surface), conveying the sheet again to the image forming unit, and forming an image on an opposite surface (a second surface) of the sheet (double-sided printing).

Japanese Patent Laid-Open No. 2008-162744 discloses a configuration having a discharge pair of rollers for discharging sheets and a reversing pair of rollers for reversing the sheets. The configuration disclosed in Japanese Patent Laid-Open No. 2008-162744 adopts a switch back system for reversing sheets by rotating the reversing pair of rollers forward and backward.

However, Japanese Patent Laid-Open No 2008-162744 does not disclose a configuration for holding the discharge pair of rollers and the reversing pair of rollers. A configuration having a member for holding the discharge pair of rollers and a member for holding the reversing pair of rollers leads to an increase in the number of components or the size of the apparatus. Another conceivable configuration is such that two rollers are held by a single holding member. In this case, the holding member can be deformed in a longitudinal direction when subjected to nipping pressure (stress) from one direction.

SUMMARY OF THE INVENTION

An image forming apparatus for forming an image on a sheet according to a first aspect of the present invention includes an image forming unit, a first pair of rollers, a second pair of rollers, and a holder. The image forming unit is configured to form an image on a sheet. The first pair of rollers is configured to discharge the sheet out of the apparatus, the image having been formed on a first surface of the sheet by the image forming unit. The second pair of rollers is configured to convey the sheet again to the image forming unit to form an image on a second surface of the sheet opposite to the first surface. The holder is configured to hold one of the first pair of rollers and one of the second pair of rollers.

A sheet conveying unit for conveying a sheet according to a second aspect of the present invention includes a first pair of rollers, a second pair of rollers, a movable guide member, and a holder. The first pair of rollers is configured to convey the sheet in a first direction. The second pair of rollers is configured to convey the sheet in a second direction. The movable guide member is disposed upstream in a direction in which the sheet is conveyed by the first pair of rollers and the second pair of rollers. The movable guide member is movable between a first position at which the movable guide member guides the sheet toward the first pair of rollers and a second position at which the movable guide member guides the sheet toward the second pair of rollers. The holder is configured to hold one of rollers of the first pair of rollers and one of rollers of the second pair of rollers.

Further features of the present invention will become apparent from the following description of exemplary embodiments with reference to the attached drawings.

DESCRIPTION OF THE EMBODIMENTS

First Embodiment

Figure 1:
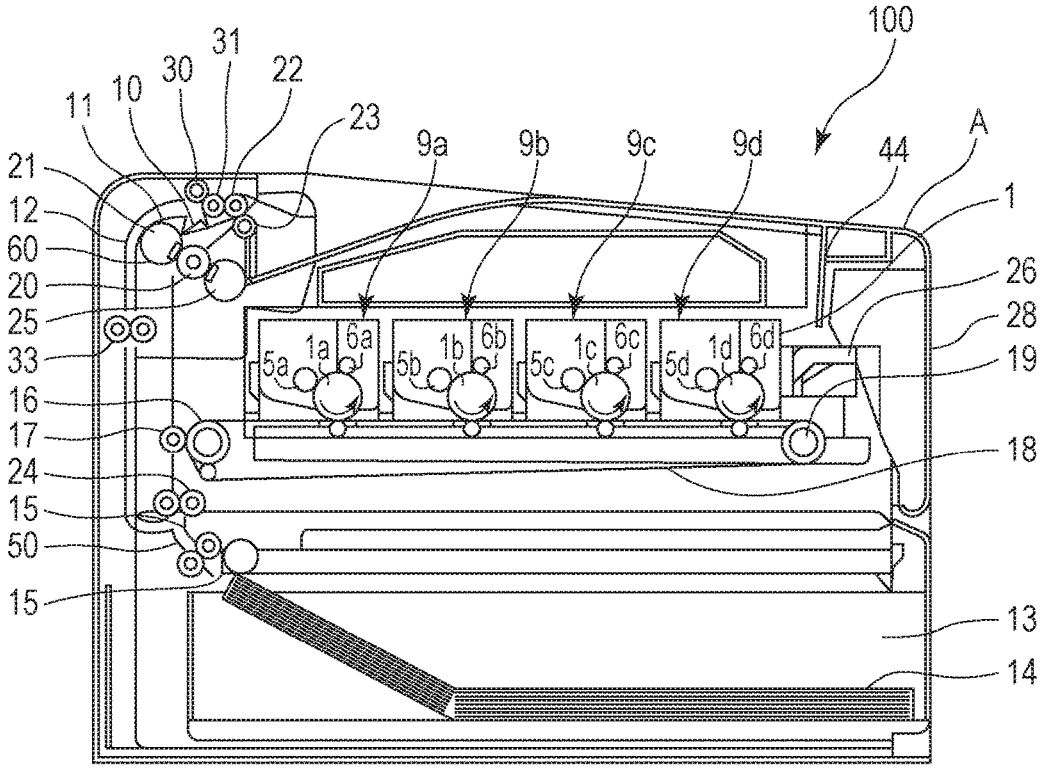
FIG. 1 is a diagram illustrating an electrophotographic image forming apparatus according to a first embodiment of the present invention.

Referring to FIG. 1, a color electrophotographic image forming apparatus (hereinafter referred to as "image forming apparatus" or "apparatus") 100 according to a first embodiment will be described. In one example, a full-color laser beam printer is used as the image forming apparatus 100. The general arrangement and functions of the image forming apparatus 100 will be described hereinbelow. The present invention can be applied not only to the full-color laser beam printer but also to a color electrophotographic copying machine, a facsimile machine, and other image forming apparatuses.

Outline of Image Forming Apparatus

First, the configuration of the image forming apparatus 100 will be described. FIG. 1 is a cross-sectional view of the image forming apparatus 100 according to the first embodiment illustrating the configuration thereof. A main body A has a configuration in which a cartridge tray (a cartridge support member) 26 and process cartridges (cartridges) 9 (9*a*, 9*b*, 9*c*, and 9*d*) are removed from the image forming apparatus 100.

In the following description, the front side of the main body A (the front of the main body A) is a side at which a door (an opening and closing member) 28 is disposed so as to be opened with respect to the main body A (the right in (FIG. 1). The door 28 openably closes an opening in an outer wall 44 of the main body A. In other words, the door 28 opens and closes the opening. In other words, the opening is provided in the outer wall 44, through which the tray 26 passes when moving between an inside position and an outside position. The back of the main body A is a side opposite to the door 28, at which a conveying path 50 for sheets 14 is disposed (the left in FIG. 1.

The main body A of the image forming apparatus 100 accommodates a sheet cassette (a stack unit) 13 in which the sheets 14 (recording media) are stacked, a feed roller 15, an intermediate transfer belt 18, and a fixing unit 60 including a fixing roller 20, a pressure roller 21, and a laser scanner. The main body A further includes the cartridge tray 26 that is movable between the inside position and the outside position with respect to the main body A. The cartridge tray 26 detachably supports the process cartridges 9 (9*a*, 9*b*, 9*c*, and 9*d*). The cartridges 9 each integrally include a drum-shaped electrophotographic photosensitive member (hereinafter referred to as "photosensitive drum") 1 (1*a*, 1*b*, 1*c*, or 1*d*), a developing roller 5 (a developing member 5*a*, 5*b*, 5*c*, or 5*d*) and a charge roller) 6 (6*a*, 6*b*, 6*c*, and 6*d*) serving as a processing unit working on the photosensitive drum 1. The individual cartridges 9 are detachably supported by (attached to) the cartridge tray 26 and are attached to an image forming position (attaching portion) in the main body A.

The sheets 14 stacked in the sheet cassette 13 are fed by the feed roller 15 that rotates clockwise (FIG. 1) into a nip portion between a resist pair of rollers 24. Next, the sheets 14 are conveyed to a nip portion (a transfer portion) between the belt driving roller 16 and the transfer roller 17.

The photosensitive drums 1 start to rotate counterclockwise (FIG. 1), and their circumferential surfaces are electrostatically charged by the charge rollers 6. The charged photosensitive drums 1 are irradiated with laser beam coming from the laser scanner. This causes electrostatic latent images to be formed in sequence on the photosensitive drums 1. Subsequently, the electrostatic latent images are developed using developers (not shown) by the developing rollers 5. Thus, developer images are formed on the circumferential surfaces of the photosensitive drums 1. The cartridges 9 have the same configuration except that the colors of developers differ. The cartridge 9*a* contains a yellow developer and forms a yellow developer image on the photosensitive drum 1*a*. The cartridge 9*b* contains a magenta developer and forms a magenta developer image on the photosensitive drum 1*b*. The cartridge 9*c* contains a cyan developer and forms a cyan developer image on the photosensitive drum 1*c*. The cartridge 9*d* contains a black developer and forms a black developer image on the photosensitive drum 1*d*.

The developer images formed on the photosensitive drums 1 are transferred to the intermediate transfer belt 18. In forming a color image, yellow, magenta, cyan, and black developer images formed on the photosensitive drums 1 are primarily transferred in sequence to the intermediate transfer belt 18. The intermediate transfer belt 18 is an endless belt that rotates in contact with the individual photosensitive drums 1 and is stretched round the belt driving roller 16 and the tension roller 19. The developer image transferred to the intermediate transfer belt 18 is secondarily transferred to the sheet 11 conveyed to the nip portion between the belt driving roller 16 and the transfer roller 17.

The sheet 14 to which the developer image is transferred is conveyed to the fixing unit 60 including the heating roller 25, the fixing roller 20, and the pressure roller 21. The sheet is heated and pressed at the nip portion between the fixing roller 20 and the pressure roller 21. This causes the developer image to be fixed on the sheet 14. In other words, a color image is formed on the sheet 14. In forming a monochrome image on the sheet 14, only a black developer image is formed on the photosensitive drum 1*d* and is transferred to the sheet 14.

Figure 3:
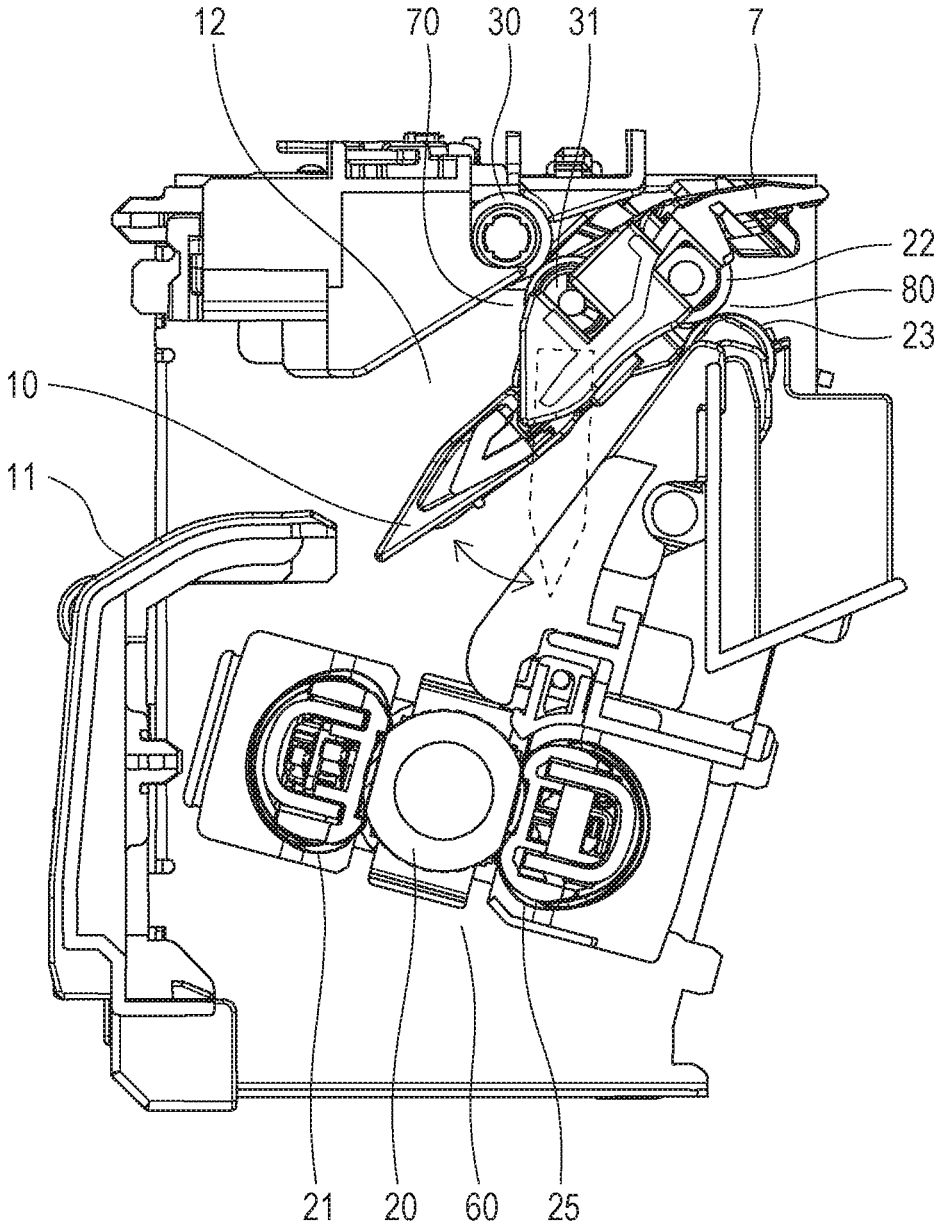
FIG. 3 is a diagram illustrating the discharge units and the reversing units of the electrophotographic image forming apparatus according to the first embodiment.

In forming images on both sides of the sheet 14, the sheet 14 to which a toner image is fixed by the fixing unit 60 is guided by a flapper (a movable guide member) 10 positioned at the broken-line position (a second position) in FIG. 3 into the nip portion between the reversing pair of rollers (a second pair of rollers). The reversing pair of rollers includes a reversing roller 30 (a third roller) and a reverse idler roller 31 (a fourth roller).

By rotating the reversing roller 30 backward before the timing at which the trailing end of the sheet 14 conveyed to the forwardly rotating reversing pair of rollers passes through the nip portion of the reversing pair of rollers, the sheet 14 is conveyed toward a conveyance guide 11 that forms a double-sided conveying path 12 by the reversing pair of rollers. The sheet 14 is again conveyed toward the resist pair of rollers 24 by a conveying roller 33 in the double-sided conveying path 12. Subsequently, an image is formed on a second surface of the sheet 14, as described above.

Figure 7:
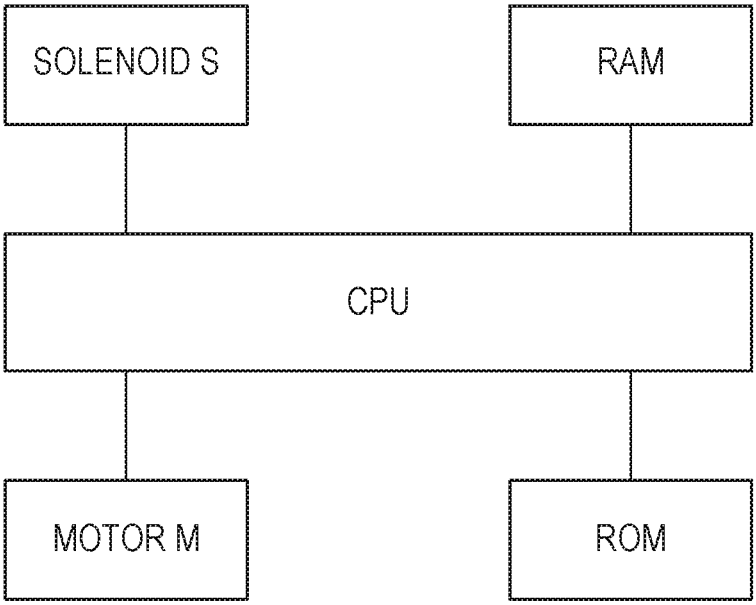
FIG. 7 is a block diagram of the electrophotographic image forming apparatus according to the first embodiment.

In discharging the sheet 14, the sheet 14 on which a toner image is fixed by the fixing unit 60 is guided by the flapper 10 at the solid-line position (a first position) in FIG. 3 and is conveyed to a nip portion between a discharge pair of rollers (a first pair of rollers). The discharge pair of rollers includes a discharge roller 22 (a first roller) and a discharge idler roller 23 (a second roller). The movable flapper 10, which is a switching unit for switching the conveying path, is operated by a CPU (a control unit) controlling a solenoid S, as shown in the block diagram in FIG. 7. The CPU is connected to a motor M (a driving unit) that generates a driving force for rotating the discharge roller 22 and the reversing roller 30.

The discharge roller 22 is a driving roller driven by a driving source, and the discharge idler roller 23 is a driven roller which is disposed under the discharge roller 22 and rotates with the rotation of the discharge roller 22. The reversing roller 30 is a driving roller, and the reverse idler roller 31 is a driven roller that is disposed under the reversing roller 30 and rotates with the rotation of the reversing roller 30. The direction of the axis of the discharge roller 22 and the direction of the axis of the reversing roller 30 are substantially parallel (in the first embodiment, parallel) to each other. The center of rotation of the reverse idler roller 31 is nearer to the center of rotation of the discharge roller 22 than to the center of rotation of the discharge idler roller 23.

Configurations of Discharge Unit and Reversing Unit

Figure 2:
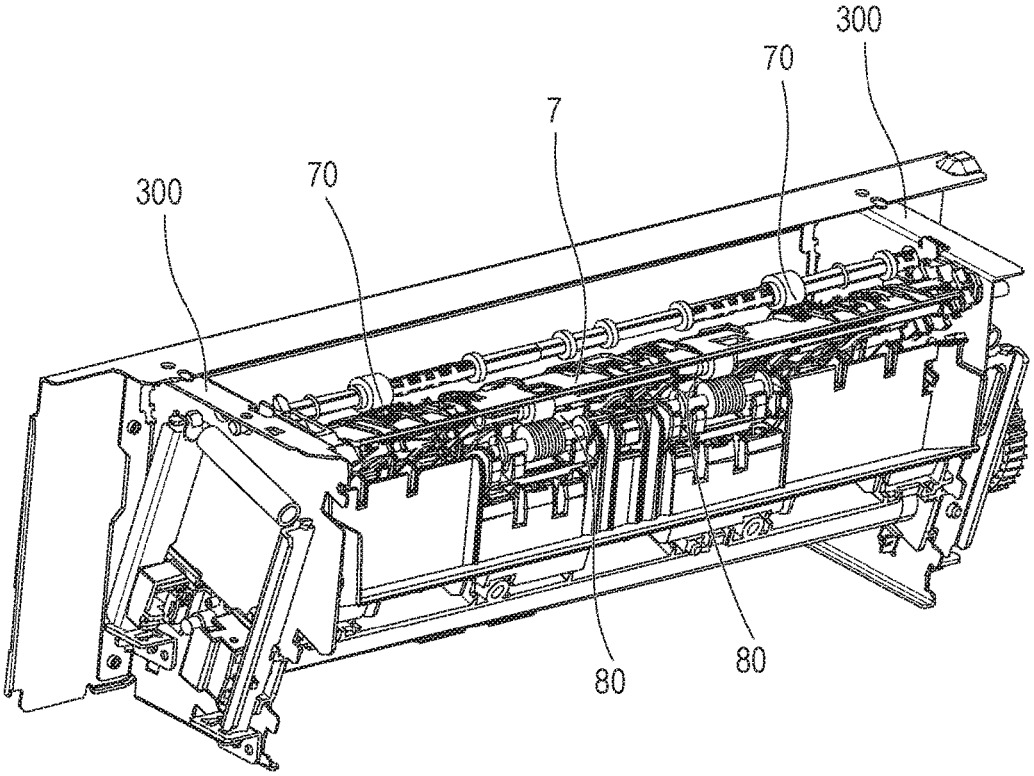
FIG. 2 is a diagram illustrating discharge units and reversing units of the electrophotographic image forming apparatus according to the first embodiment.
Figure 4A:
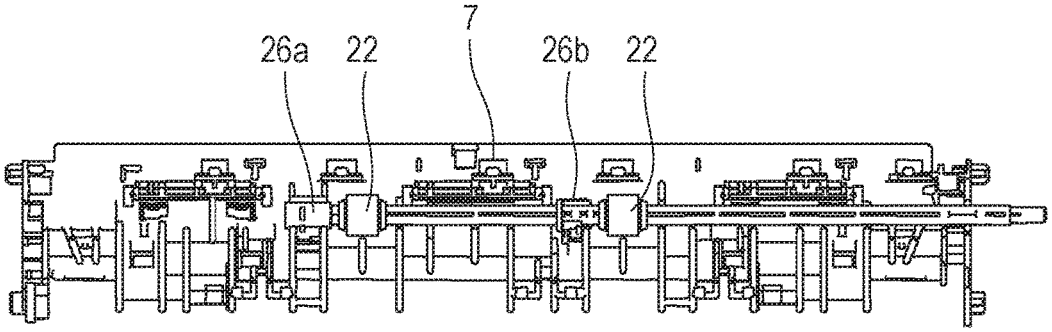
FIG. 4A is a diagram illustrating the discharge units of the electrophotographic image forming apparatus according to the first embodiment.
Figure 4B:
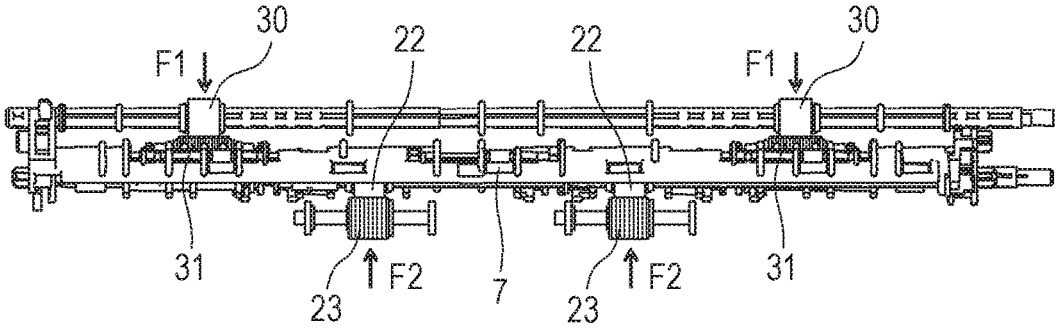
FIG. 4B is a diagram illustrating the discharge units of the electrophotographic image forming apparatus according to the first embodiment.
Figure 5A:
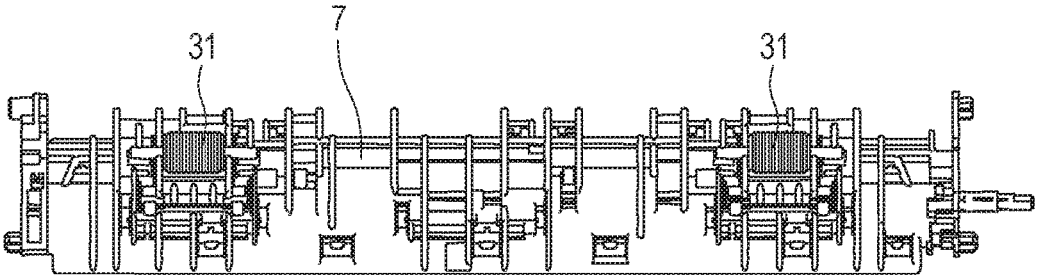
FIG. 5A is a diagram illustrating the reversing units of the electrophotographic image forming apparatus according to the first embodiment.
Figure 5B:
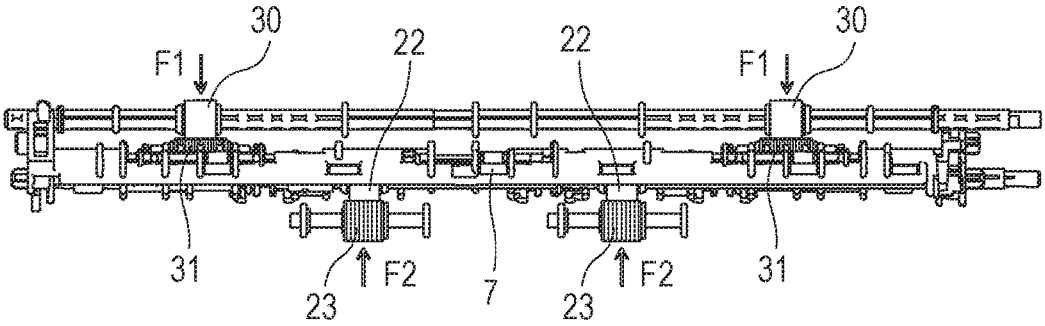
FIG. 5B is a diagram illustrating the reversing units of the electrophotographic image forming apparatus according to the first embodiment.
Figure 6:
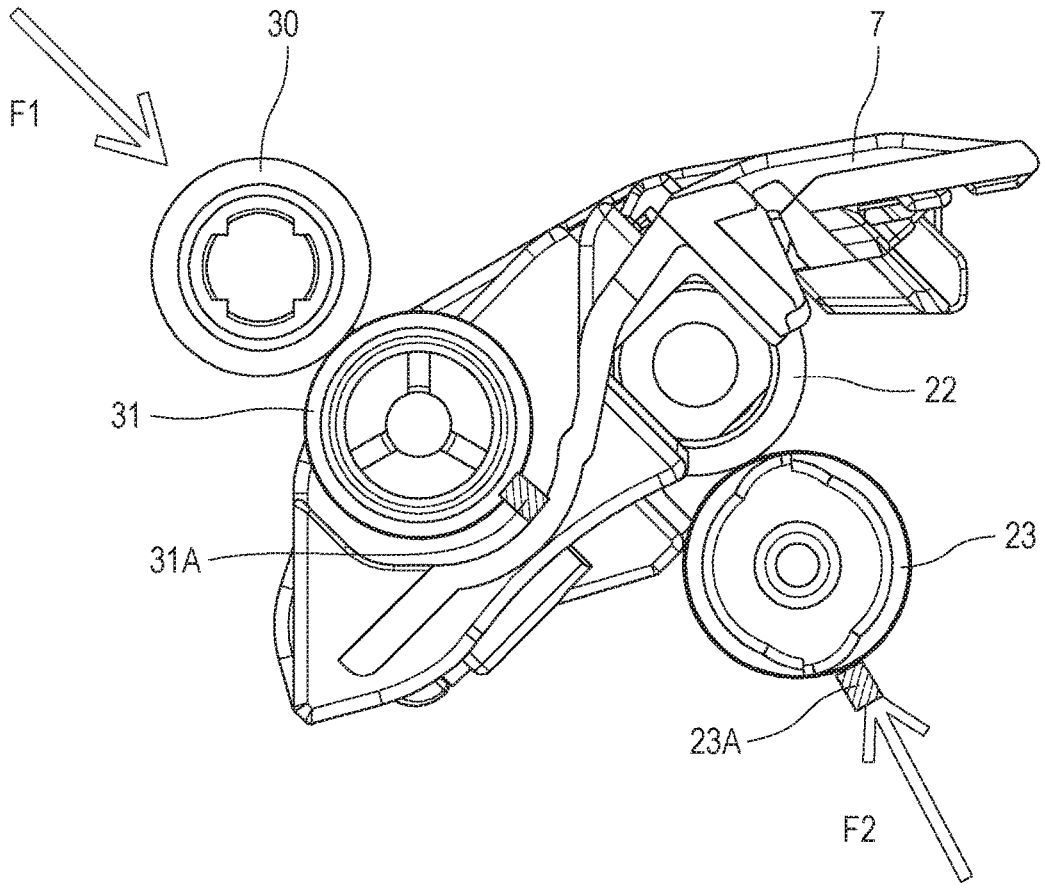
FIG. 6 is a diagram illustrating the discharge units and the reversing units of the electrophotographic image forming apparatus according to the first embodiment.

The configurations of discharge units 80 and reversing units 70 of the first embodiment will be described with reference to FIGS. 2 to 6. FIG. 2 is a schematic perspective view of the vicinity of the discharge units 80 and the reversing units 70. FIG. 3 is an enlarged cross-sectional view of the vicinity of the discharge units and the reversing units 70. FIGS. 4A and 4B are schematic diagrams of the vicinity of the discharge units 80. FIGS. 5A and 5B are schematic diagrams of the vicinity of the reversing units 70. FIG. 6 is an enlarged cross-sectional view of the discharge units 80 and the reversing units 70.

As shown in FIGS. 2 and 3, the discharge units 80 each include the discharge roller 22 and the discharge idler roller 23. As shown in FIGS. 4 and 6, the discharge rollers 22 and their rotation shafts are rotatably held by a bearing 26*a* and a bearing 26*b* of a holding member 7. As shown in FIG. 6, the discharge idler roller 23 is elastically urged to the discharge roller 22 by an elastic member 23A. The discharge roller 22 and the discharge idler roller 23 form a discharge nip portion and convey the sheet 14 while nipping the sheet 14 in the nip portion. In other words, the elastic member 23A generates an elastic force for forming the discharge nip portion.

The reversing units 70 each include the reversing roller 30 and the reverse idler roller 31. As shown in FIGS. 3 and 5, the reverse idler rollers 31 are rotatably held by the holding unit 7. The rotation shaft of the reversing rollers 30 is rotatably held by a pair of side frames 300. As shown in FIG. 6, the reverse idler roller 31 is elastically urged to the reversing roller 30 by an elastic member 31A. The reverse idler roller 31 and the reversing roller 30 form a reversing nip portion and convey the sheet 14 while nipping the sheet 14 in the nip portion. In other words, the elastic member 31A generates an elastic force for forming the reversing nip portion.

As shown in FIG. 3, the holding member (a holder) 7 presses the reverse idler roller 31 of the reversing unit while rotatably holding it and rotatably holds the discharge roller 22 of the discharge unit 80. In the first embodiment, since the single holding member 7 holds one of the rollers of the discharge pair of rollers and one of the rollers of the reversing pair of rollers, the size and the number of components of the apparatus can be smaller than those of a configuration in which the individual rollers are held by separate holding members. The holding member 7 also has the function of guiding the sheet 11 at the reversing units 70 and the discharge units 80. Specifically, the lower surface (a first guide portion) of the holding member 7 has the function of guiding the upper surface of the sheet 14 conveyed by the discharge pair of rollers, and the upper surface (a second guide portion) of the holding member 7 has the function of guiding the lower surface of the sheet 14 conveyed by the reversing pair of rollers. It is only required that the holding member 7 has at least one of the first guide portion and the second guide portion.

Since the reverse idler roller 31 is urged to the reversing roller 30 by the elastic member 31A, as shown in 6, the reverse idler roller 31 undergoes a nip pressure (reactive force) F1 from the reversing roller 30 to apply stress to the holding member 7. The discharge roller 22 that undergoes a nip pressure F2 from the discharge idler roller 23 urged by the elastic member 23A applies stress to the holding member 7. In other words, as shown in FIG. 6, the holding member 7 undergoes stresses from two opposing directions F1 and F2 in a cross section perpendicular to the direction of the axes of the discharge pair of rollers and the reversing pair of rollers (viewed from the direction of the axes). In other words, the direction F1 in which the elastic member 31A acts on the holding member 7 and the direction F2 in which the elastic member 23A acts on the holding member 7 are opposite (opposed). Thus, the first embodiment allows the stresses from the two opposing directions to be offset by the holding member 7, thereby preventing the holding member 7 from being deformed in the thickness direction. This eliminates the need for increasing the thickness of the holding member 7 in cross section, decreasing the height of the apparatus main body, thus leading to reduction in the size of the apparatus. Furthermore, the resistance to deformation in the thickness direction of the holding member 7 reduces a decrease in discharging conveying force (discharging nip pressure) and reversing conveying force (reversing nip pressure) caused by the deformation of the holding member 7. This prevents the performance of conveying the sheets 14 from decreasing.

Examples of the elastic member 31A and the elastic member 23A include a compression spring and a twisted coil spring.

In the first embodiment described above, the present invention is applied to one of the rollers of the pair of rollers of the discharge unit 80 and one of the rollers of the pair of rollers of the reversing unit 70.

Although, in the first embodiment described above, the discharging nip portion between the discharge pair of rollers is disposed inner than the reversing nip portion between the reversing pair of rollers in the longitudinal direction (along the axis of the rollers) (in different positions), as shown in FIGS. 4A to 5B, the present invention is not limited to the above configuration. In other words, the present invention may be applied to a configuration in which the reversing pair of rollers is disposed inner than the discharge pair of rollers in the longitudinal direction or a configuration in which the discharge pair of rollers and the reversing pair of rollers are disposed at the same position in the longitudinal direction.

In the first embodiment described above, the discharge pair of rollers and the reversing pair of rollers are disposed as in FIG. 6. This is not intended to limit the present invention. For example, the present invention may have a configuration in which the discharge roller 22 and the discharge idler roller 23 are disposed at positions opposite to the first embodiment. Likewise, the present invention may have a configuration in which the reversing roller 30 and the reverse idler roller 31 are disposed at positions opposite to the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-103961, filed May 21, 2015, which is hereby incorporated by reference herein in its entirety.

What is claimed is:

1. An image forming apparatus for forming an image on a sheet, the apparatus comprising:

an image forming unit configured to form an image on a sheet;

a first pair of rollers configured to discharge the sheet out of the apparatus, the image having been formed on a first surface of the sheet by the image forming unit;

a second pair of rollers configured to convey the sheet again to the image forming unit to form an image on a second surface of the sheet opposite to the first surface;

a third pair of rollers configured to convey the sheet toward the first pair of rollers and the second pair of rollers; and a holder configured to hold one of the first pair of rollers and one of the second pair of rollers, wherein the first pair of rollers comprises a first roller and a second roller that rotates with the first roller, wherein the second pair of rollers comprises a third roller and a fourth roller that rotates with the third roller, a rotation center of the fourth roller being disposed nearer to a rotation center of the first roller than to a rotation center of the second roller, wherein the first roller and the fourth roller are held by the holder, wherein a direction in which the first roller is pressed by the second roller and a direction in which the fourth roller is pressed by the third roller are opposite to each other, wherein the first roller is rotated by driving a driving source, and the second roller is rotated by rotation of the first roller, and wherein the third roller is rotated by driving a driving source, and the fourth roller is rotated by the third roller, and wherein the first and the second pair of rollers are arranged respectively at the respective most downstream side of a path through which the sheet is conveyed and an upstream edge of the holder is arranged downstream of the third pair of the rollers, the third pair of the rollers conveying the sheet right before the first and second pair of rollers.

2. The apparatus according to claim 1, wherein the second pair of rollers rotates in a first rotation direction and then rotates in a second rotation direction opposite to the first rotation direction to convey the sheet to the image forming unit again.

3. The apparatus according to claim 1, wherein the holder comprises a guide portion configured to guide the sheet conveyed by at least one of the first pair of rollers and the second pair of rollers.

4. A sheet conveying unit for conveying a sheet, the unit comprising:

a first pair of rollers configured to convey the sheet in a first direction;

a second pair of rollers configured to convey the sheet in a second direction;

a movable guide member disposed upstream of the first pair of rollers and the second pair of rollers in a sheet conveying direction, the movable guide member being movable between a first position at which the movable guide member guides the sheet toward the first pair of rollers and a second position at which the movable guide member guides the sheet toward the second pair of rollers;

a third pair of rollers configured to convey the sheet toward the first pair of rollers and the second pair of rollers, the third pair of rollers comprising a fifth roller and a sixth roller; and a holder configured to hold one of the first pair of rollers and one of the second pair of rollers, wherein the first pair of rollers comprises a first roller and a second roller that rotates with the first roller, wherein the second pair of rollers comprises a third roller and a fourth roller that rotates with the third roller, a rotation center of the fourth roller being disposed nearer to a rotation center of the first roller than to a rotation center of the second roller, wherein the first roller and the fourth roller are held by the holder, wherein a direction in which the first roller is pressed by the second roller and a direction in which the fourth roller is pressed by the third roller are opposite to each other, wherein the first roller is rotated by driving a driving source, and the second roller is rotated by rotation of the first roller, wherein the third roller is rotated by driving a driving source, and the fourth roller is rotated by the third roller, and wherein the first pair of rollers and the second pair of rollers are arranged respectively at the respective most downstream side of a path through which the sheet is conveyed and an upstream edge of the holder is arranged downstream of the third pair of rollers, the third pair of rollers conveying the sheet right before the first pair of rollers and the second pair of rollers.

5. The unit according to claim 4, wherein the holder comprises a guide portion configured to guide the sheet conveyed by at least one of the first pair of rollers and the second pair of rollers.

6. An image forming apparatus for forming an image on a sheet, the apparatus comprising:

an image forming unit configured to form an image on a sheet;

a first pair of rollers configured to discharge the sheet out of the apparatus, the image having been formed on a first surface of the sheet by the image forming unit;

a second pair of rollers configured to convey the sheet again to the image forming unit to form an image on a second surface of the sheet opposite to the first surface a third pair of rollers configured to convey the sheet toward the first pair of rollers and the second pair of rollers; and a holder configured to hold one of the first pair of rollers and one of the second pair of rollers, wherein the first pair of rollers comprises a first roller and a second roller that rotates with the first roller, wherein the second pair of rollers comprises a third roller and a fourth roller that rotates with the third roller, a rotation center of the fourth roller being disposed nearer to a rotation center of the first roller than to a rotation center of the second roller, wherein the first roller and the fourth roller are held by the holder, wherein a direction in which the first roller is pressed by the second roller and a direction in which the fourth roller is pressed by the third roller are opposite to each other, and wherein the first pair of rollers and the second pair of rollers are arranged respectively at the respective most downstream side of a path through which the sheet is conveyed and an upstream edge of the holder is arranged downstream of the third pair of the rollers, the third pair of the rollers conveying the sheet right before the first pair of rollers and the second pair of rollers.

* * * * *